US009808951B2

(12) United States Patent
Matsunaga

(10) Patent No.: US 9,808,951 B2
(45) Date of Patent: Nov. 7, 2017

(54) SCRAP WINDER

(71) Applicant: Braner USA, Inc., Schiller Park, IL (US)

(72) Inventor: Douglas S. Matsunaga, Mettawa, IL (US)

(73) Assignee: Braner USA, Inc., Schiller Park, IL (US)

( * ) Notice: Subject to any disclaimer, the term of this patent is extended or adjusted under 35 U.S.C. 154(b) by 400 days.

(21) Appl. No.: 14/685,650

(22) Filed: Apr. 14, 2015

(65) Prior Publication Data

US 2016/0303753 A1 Oct. 20, 2016

(51) Int. Cl.
*B26D 7/18* (2006.01)
*B65H 54/58* (2006.01)
*B26D 1/03* (2006.01)

(52) U.S. Cl.
CPC ..... *B26D 7/18* (2013.01); *B65H 54/585* (2013.01); *B26D 1/035* (2013.01); *B65H 2701/37* (2013.01)

(58) Field of Classification Search
CPC ..... B26D 7/18; B65H 54/585
USPC ..... 242/525.3; 83/107
See application file for complete search history.

(56) References Cited

U.S. PATENT DOCUMENTS 4,093,140 A * 6/1978 Matsunaga ..... B65H 18/103 242/529
4,467,975 A * 8/1984 Friedman ..... B21C 47/006 242/419.5
4,470,555 A * 9/1984 Lawson ..... B23D 19/06 226/19
4,611,518 A * 9/1986 Hildebrandt ..... B26D 7/18 242/525.3
5,826,474 A * 10/1998 Howard ..... B26D 7/18 83/105
5,899,129 A * 5/1999 Sumida ..... B26D 7/18 83/100

* cited by examiner

*Primary Examiner* — Sang Kim
(74) *Attorney, Agent, or Firm* — Botkin & Hall, LLP

(57) ABSTRACT

A scrap winder is provided as part of a slitting line that creates a ribbon of scrap. The scrap winder has a moveable mandrel that exposes a grabbing portion that rotates. The grabbing portion extends outward to reveal a puller cable reel. The puller cable reel contains a retrieving cable that attaches to the start of the scrap ribbon. As the grabbing portion rotates, the scrap is brought to the grabbing portion, where the scrap is attached directly to it. The mandrel is then moved into position and the scrap can be wound around the mandrel.

19 Claims, 6 Drawing Sheets

SCRAP WINDER

BACKGROUND OF THE INVENTION

This present disclosure relates to slitting of coil stock and the proper and safe collection of the scrap that is necessarily generated. When coil stock is slitted, the edge quality, width variation, or the total width of the individual slit coils necessarily generates edge trim scrap. This scrap is typically a thin continuous ribbon that is generated while the slitter is processing the coil stock. Scrap must be handled with care and properly captured. Scrap can be wound or chopped. A scrap chopper slices the scrap into individual lengths while it is being generated. Winders coil up the scrap into one continuous coil. Current winders in the art involve a few different styles. A first style is a fixed spool where the scrap is wound. The spool stores the scrap and is also used to transport it. A second style involves a spool with a collapsible spindle. The collapsible spindle design is open on one end while the coil is being wound. When the scrap winder spool is full, the spindle is collapsed enough to release the scrap coil bundle. Feeding the scrap winder is dangerous and difficult, especially when dealing with a large gauge metal or an unpredictable material. An improved scrap winder is necessary.

SUMMARY OF THE INVENTION

The present disclosure describes a scrap winder that has a mandrel that rotates on a pivoting frame. The pivoting frame pivots upward to allow gravity to release the bundle of wound scrap from the mandrel. The mandrel is tapered to facilitate releasing the wound scrap. A yoke slides a sliding hub between an extended position to a refracted position. The extended position allows a cable to be unwound and mated to the beginning of a strip of scrap. When the scrap is pulled enough to be engaged with the hub, it is placed between protrusions or a grouping of posts that causes the scrap to coil when the hub is rotated, also known as a grab. The hub is then retracted and the mandrel is pivoted down to mate with the hub. As the scrap is wound, the mandrel begins to fill up.

BRIEF DESCRIPTION OF THE DRAWINGS

A preferred embodiment of this invention has been chosen wherein.

DESCRIPTION OF THE PREFERRED EMBODIMENT

Figure 1:
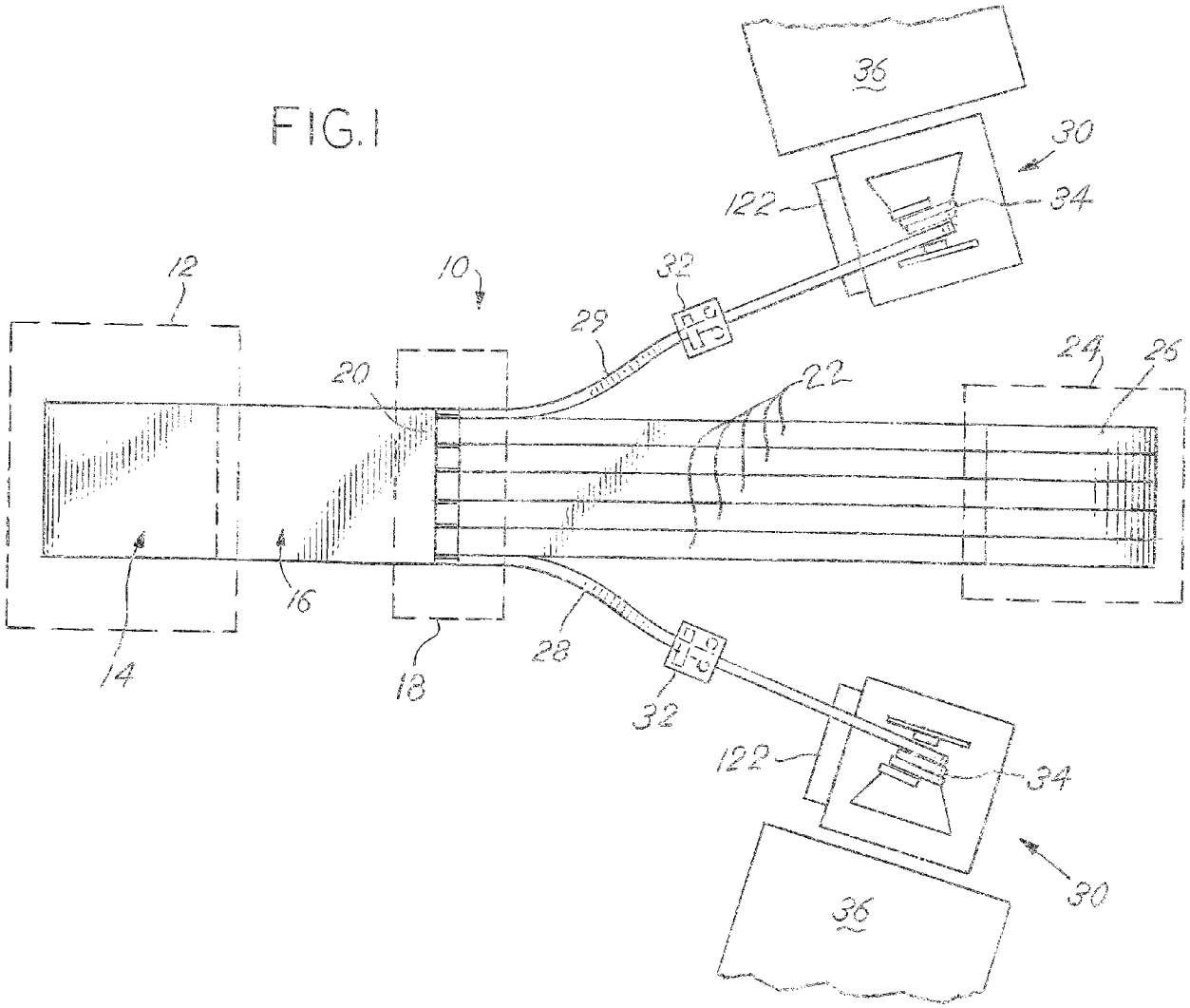
FIG. 1 is a top view of the slitting line.

A slitting line 10 has an uncoiler station 12 where a master coil 14 of sheet metal 16 is unwound. The sheet metal 16 then proceeds to a slitting station 18 where a series of rotating knives 20 separate the sheet metal 16 into strips 22 of a predetermined width. These strips 22 then proceed to a coiling station 24 where they are wound into slit strip 26. At the slitting station 18, a ribbon of edge trim 28 is generated. The edge trim 28 is generated because of the edge quality of the master coil 14 and/or the combined width of the strips 22 may not add up perfectly to the width of the sheet metal 16. This edge trim 28 is generated as the sheet metal 16 is slit into strips 22 and must be handled properly. The edge trim 28 can have razor sharp edges in the cases of thin stock and be very dangerous for the user to handle. Other times, the stock may be thick material that is difficult to wrestle from the slitter station 18 to the scrap winder 30. The scrap winder 30 is designed to safely wind and handle the edge trim 28. The scrap winder 30 winds the edge trim 28 at the same speed as the slitting line 10 to maintain tension on it during winding. Depending on the arrangement of the portions of the slitting line 10, an eyelet 32 can be inline between the scrap winder 30 and the slitting station 18. The eyelet 32 is affixed to the floor or part of the slitting line 10 to guide the edge trim 28 from the slitting station 18 to the scrap winder 30. As shown in FIG. 1, the slitting line 10 has two scrap winders 30 that are mirror images of each other, but other configurations are possible.

Figure 2:
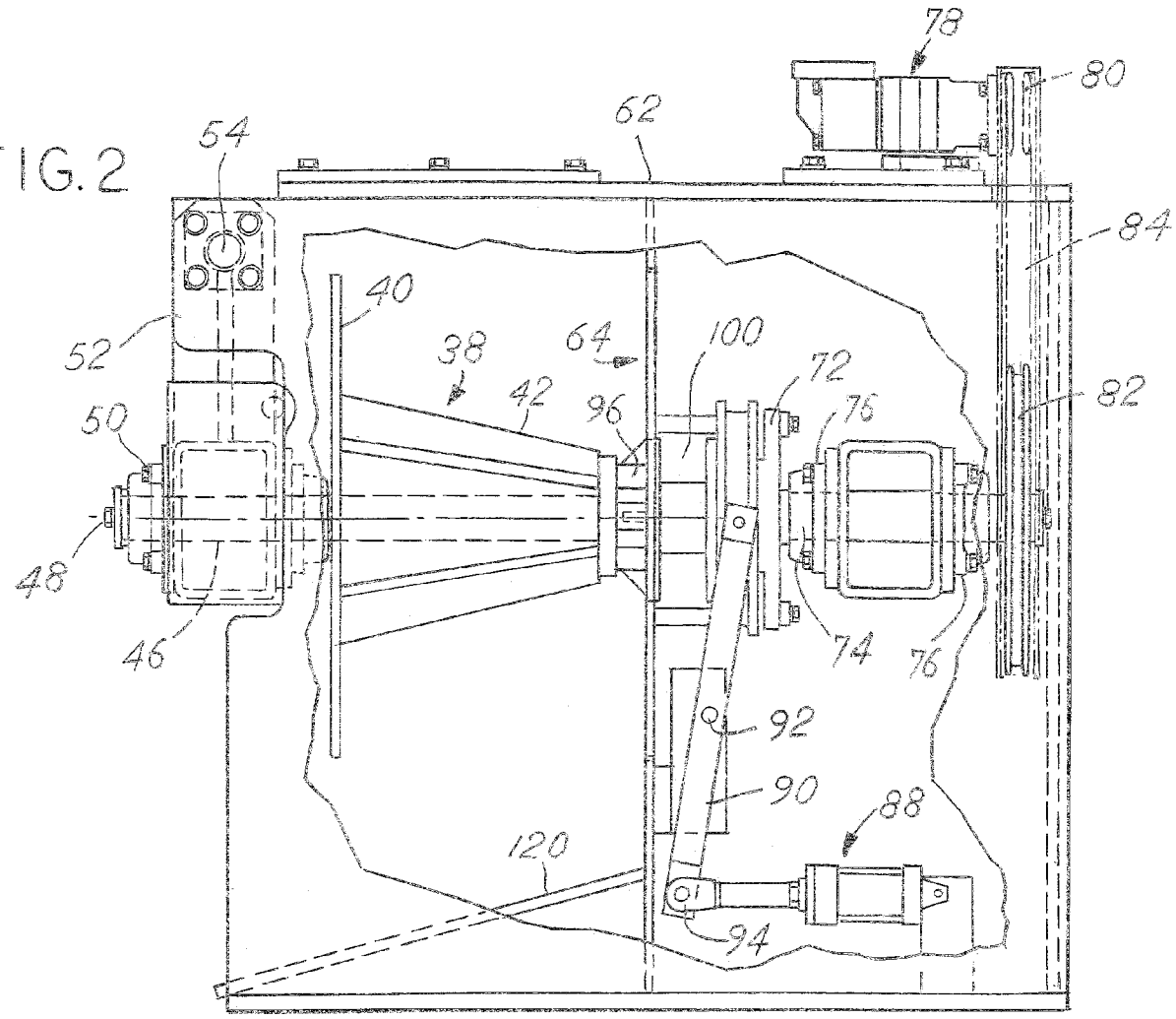
FIG. 2 is a side view of the scrap winder in the winding position.
Figure 3:
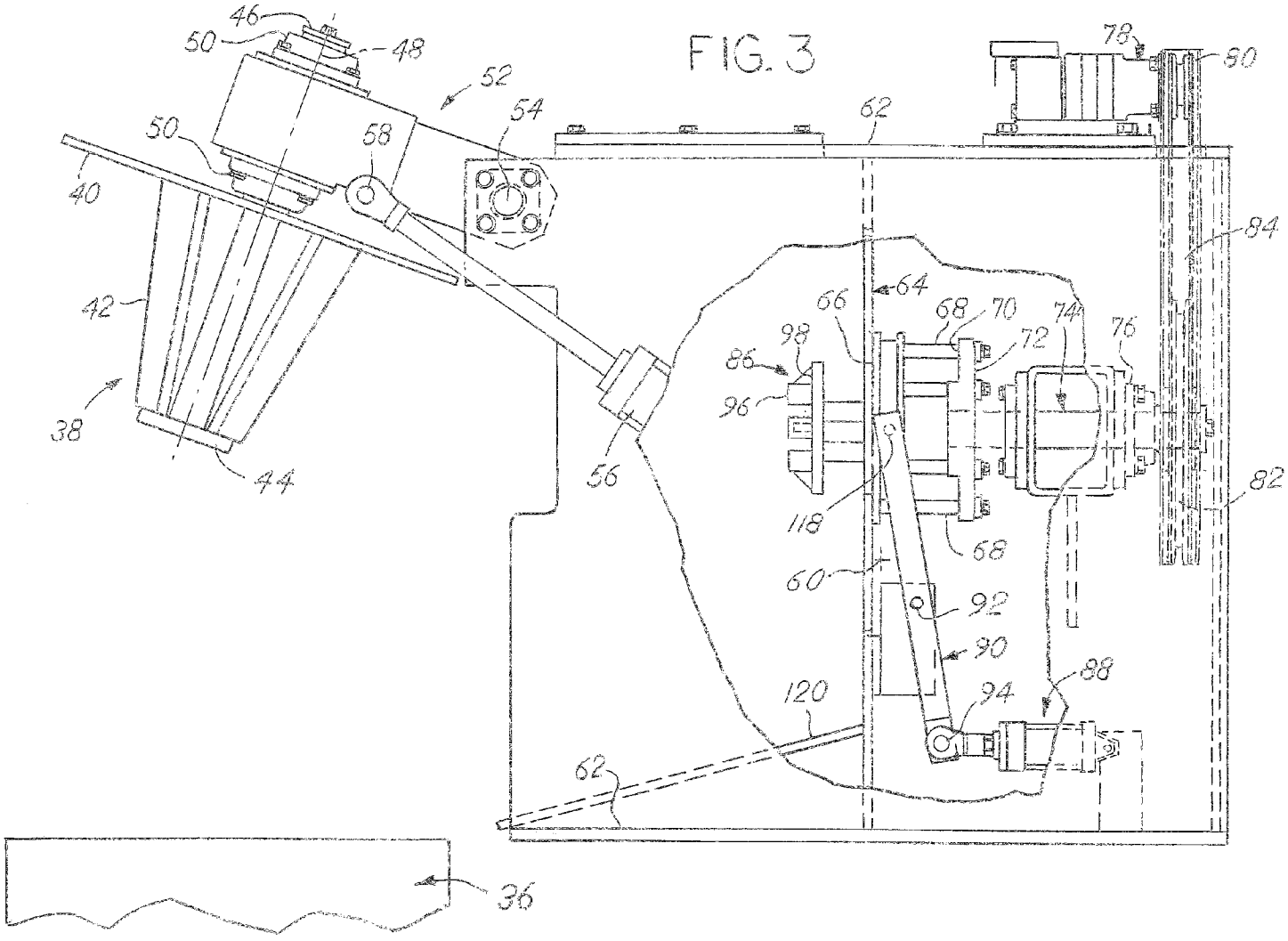
FIG. 3 is a side view of the scrap winder in the release position.

The scrap winder 30 is designed to safely coil the edge trim 28 and then transfer a scrap bundle 34 of edge trim 28 into a hopper 36. The scrap winder 30 as shown in FIGS. 2 and 3 has a tapered mandrel 38 with a flange plate 40, a tapered portion 42 and a tip 44. The tapered portion 42 is wider near the flange plate 40 and smallest near the tip 44. As shown in FIG. 3, the mandrel 38 rotates on a shaft 46 about an axis 48 and is supported by bearings 50. The mandrel is attached to a pivoting frame 52 that pivots about a pivot point 54. A cylinder 56 as shown in FIG. 3 is attached to the pivoting frame 52 at a pivoting attachment point 58 on one end and a frame attachment point 60 of the scrap winder 30 at the other end. The cylinder 56 moves the pivoting frame 52 and mandrel 38 between a winding position as shown in FIG. 2 and a release position as shown in FIG. 3. The mandrel 38 is shown as free-wheeling on bearings 50 but can be driven separately by a motor or other means.

Figure 5:
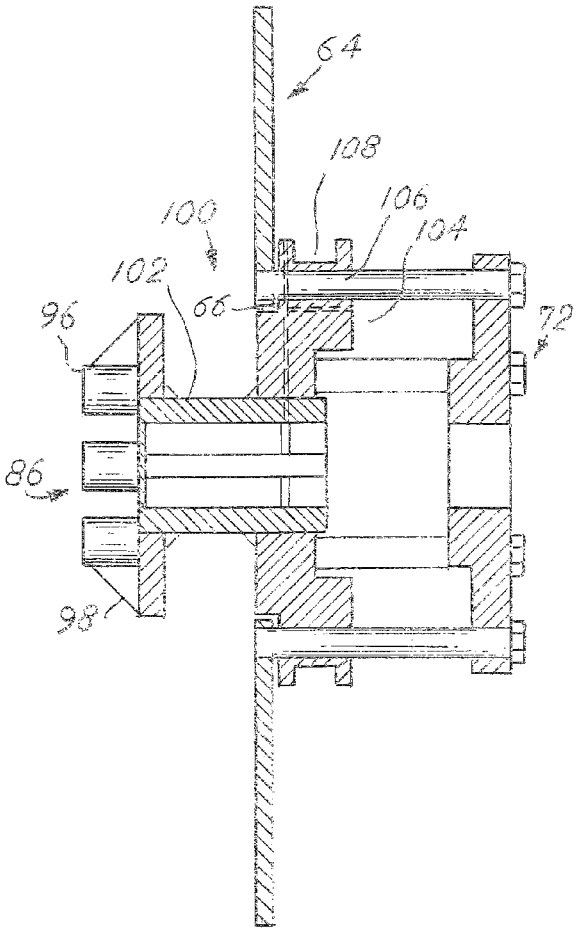
FIG. 5 is a section view similar to that of FIG. 4 showing the sliding hub in the extended position.

The scrap winder 30 has a frame 62 where various parts are attached, including the pivoting frame 52 and cylinder 56. An inboard flange plate 64 has a mandrel facing side 63 and a yoke facing side 65. As shown in FIG. 5, the inboard flange plate 64 has a center aperture 66 and a series of sliding pins 68 extending from the yoke facing side 65. At terminal ends 70 of the sliding pins 68 is a backstop 72 affixed thereto.

Figure 4:
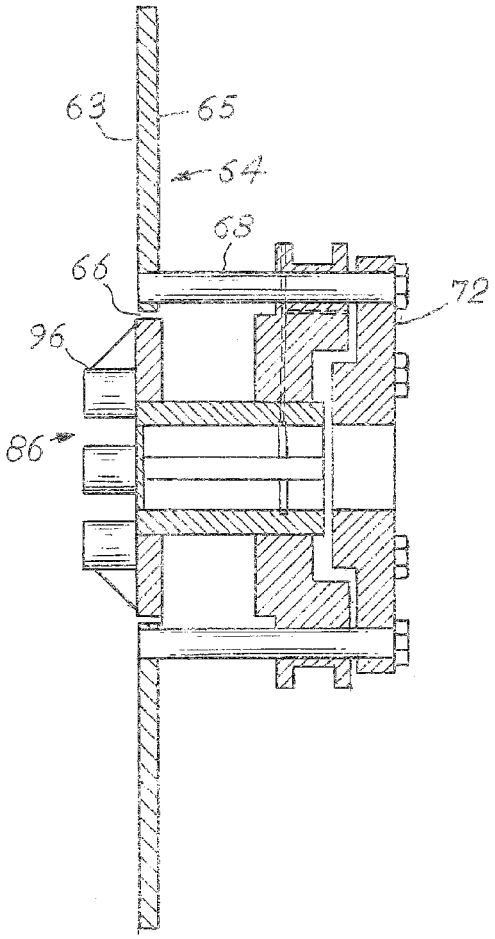
FIG. 4 is a section view taken about line 4-4 of the sliding hub in the retracted position.
Figure 6:
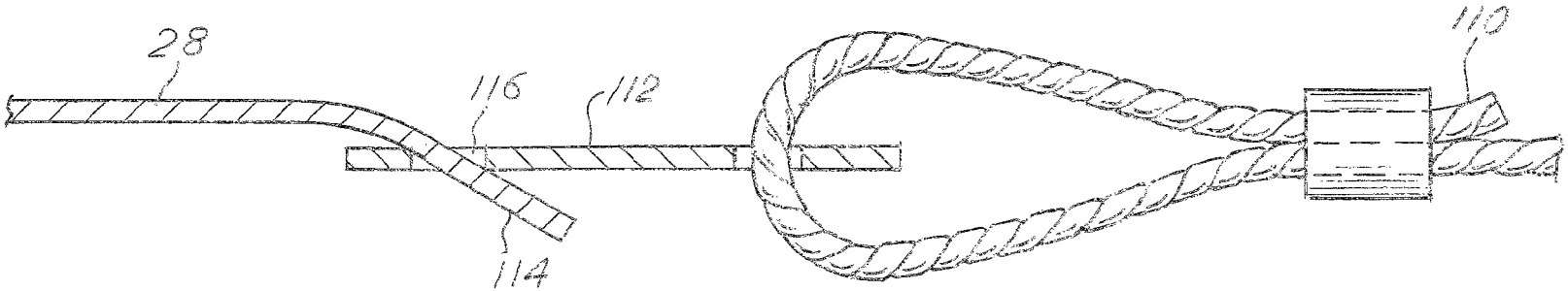
FIG. 6 is a section side view of the retrieving end of the cable.
Figure 7:
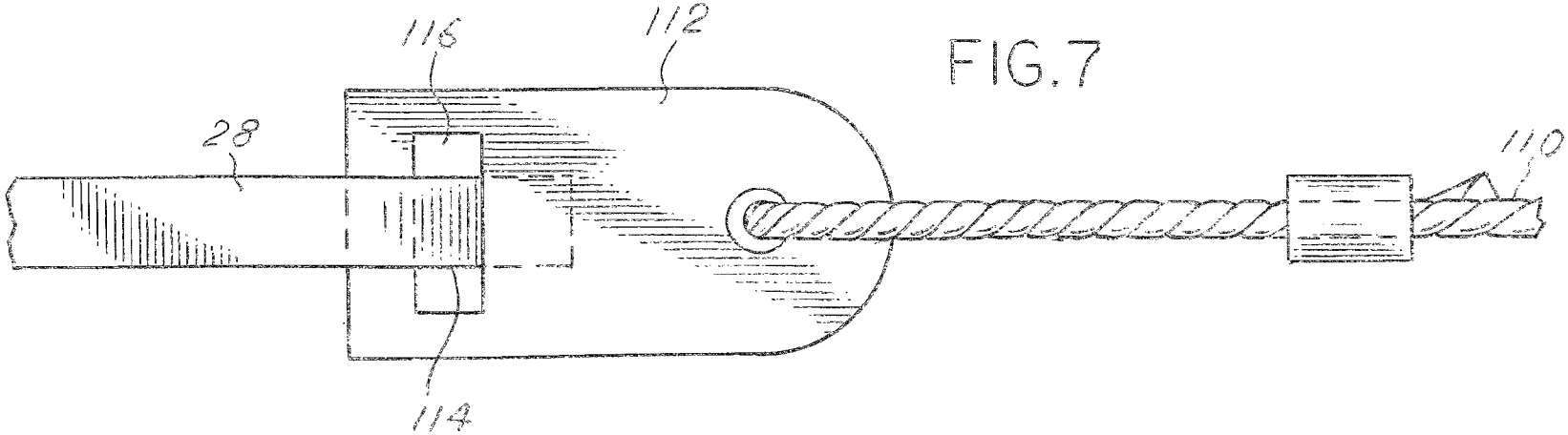
FIG. 7 is a top view of the retrieving end of the cable.

Located in the center aperture 66 is a sliding hub 86 (FIGS. 3-5). The sliding hub 86 slides between an extended position as shown in FIGS. 3 and 5 and a retracted position as shown in FIGS. 2 and 4. In the refracted position, the sliding hub is near the backstop 72. The sliding hub 86 is driven by a key affixed to the driving shaft 74 (FIG. 3) that mates with a slot 85 (FIG. 4) on the sliding hub 86. The key is affixed to the driving shaft 74 using screws or other mechanical means. It is contemplated that the driving shaft 74 is rotationally coupled to the sliding hub through a spline interface or other means that allow axial movement between the two while transferring rotational torque. The driving shaft 74 is supported by bearings 76 and driven by a motor 78 that is coupled to the driving shaft 74 through pulleys 80, 82, and a belt or chain 84. The motor 78 could be hydraulic, electric, or driven by other torque generating device. The motor drives the driving shaft 74 at a controlled torque to regulate the tension in the edge trim 28 as it is wound on the tapered mandrel 38. It is contemplated that the driving shaft 74 is driven directly by the motor 78 or other means. The sliding hub 86 slides on the sliding pins 68 and rotates with backstop 72 and inboard flange plate 64. The sliding hub 86 further includes a series of protrusions 96 that extend from a front face 98 as shown in FIGS. 4 and 5 to form a grab. Behind the front face 98 is a puller cable reel 100 as shown in FIGS. 2 and 3. The puller cable reel 100 is a sheave with a minor outside diameter 102 that is bordered on one end with the back of the front face 98 and a driving portion 104 as shown in FIGS. 4 and 5 on the other end. The driving portion 104 has a series of apertures 106 that are designed to receive the sliding pins 68. The driving portion 104 further includes a radial channel 108 that allows a yoke 90 (FIG. 3) to axially move the sliding hub 86 on the sliding pins 68. When the sliding hub 86 is refracted, the front face 98 is nearly flush with the inboard flange plate 64. When the sliding hub 86 is extended, the puller cable reel 100 is exposed to the mandrel facing surface 63, allowing the user to retrieve a cable 110 as shown in FIGS. 6 and 7. The cable 110 is affixed to the puller cable reel 100 on one end and has a clip 112 on the loose end. The clip 112 is designed to grab onto the start end 114 of the edge trim 28. The clip 112 has an aperture 116 that the start end 114 is placed into. Tension in the cable 110 causes the aperture 116 and edge trim 28 to bind, thereby grabbing the edge trim 28. For thin material, the edge trim 28 can be passed through and bent around the aperture 116 to form a more secure connection between the clip 112 and the edge trim 28. Rotating the sliding hub 86 causes the cable 110 to wind around the minor outside diameter 102 (FIGS. 4 and 5), pulling the start end 114 toward the scrap winder 30.

As shown in FIG. 2, when the pivoting frame 52 is in the winding position and the sliding hub is in the retracted position, the tip 44 of the mandrel 38 abuts terminal ends of the protrusions 96 on the sliding hub 86. This creates a winding drum, an area for the edge trim 28 to be captured and wind around the tapered portion 42.

A cylinder or actuator 88 moves the yoke 90 about a fulcrum 92 to slide the sliding hub 86 between the extended and retracted position as shown in FIGS. 2 and 3. The actuator is attached at point 94 on one end and a sliding hub mating portion 118 is located on the opposite end. The mating portion 118 is fixed to the axial position of the radial channel 108 (FIG. 2) to facilitate the movement of the sliding hub 86. The mating portion 118 allows the sliding hub 86 to rotate. It is contemplated that bushings or bearings are located in the radial channel 108 between the mating portion 118 and the radial channel 108.

Figure 8:
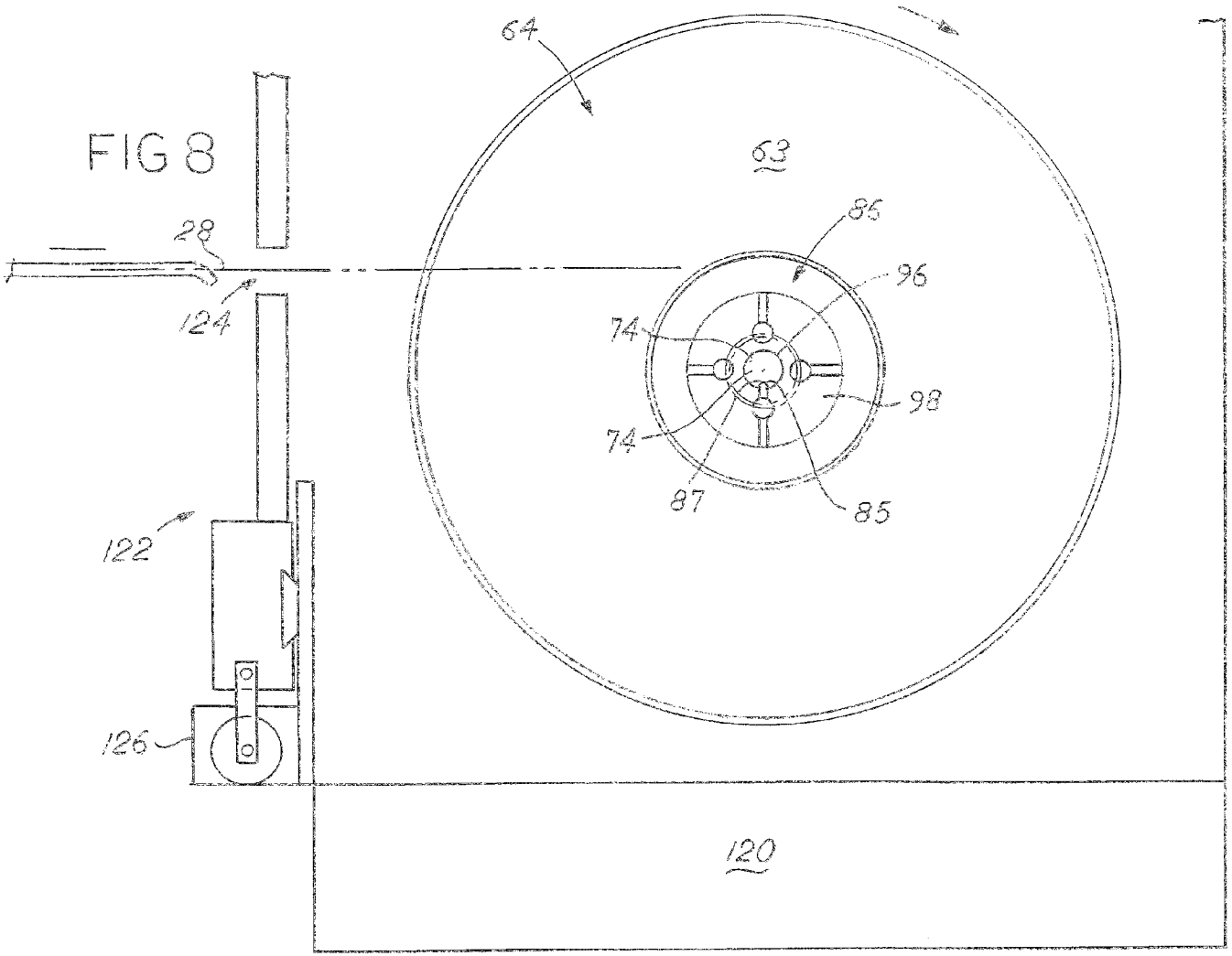
FIG. 8 is a front view of the scrap winder.

To assist a radially compact bundle 34 (FIG. 1), an oscillating guide 122 is affixed to the frame 62. The oscillating guide 122 has an aperture 124 (FIG. 8) that the edge trim 28 passes through. The guide 122 moves parallel to the axis of the driving shaft 74, driven by cylinder 126 to direct the edge trim 28 to wind around the mandrel 38 along the axis 48 instead of bunching up adjacent to the inboard flange plate 64. By directing the edge trim 28, the overall diameter of the bundle 34 can be better controlled.

When the slitting line 10 is started, the master coil 14 is unrolled and the sheet metal 16 is fed to the slitting station 18. Here, the edge trim 28 is generated with the start end 114 leading the strip. At this point, the pivoting frame 52 is moved to the release position as shown in FIG. 3 and the sliding hub 86 is in the extended position, revealing the puller cable reel 100. The cable 110 is then extended by either releasing a portion of the puller cable reel 100 or rotating the sliding hub 86. The clip 112 is then firmly attached to the start end 114 of the edge trim 28. Next, the motor 78 and driving shaft 74 are engaged, rotating the sliding hub 86 to retract the cable 110. As the start end 114 is pulled sufficiently and becomes adjacent to the front face 98, the start end 114 is disengaged from the clip 112 of the cable 110. The start end 114 is then placed between the protrusions 96, also referred to as a gripper slot. The sliding hub 86 can then be retracted and the pivoting frame 52 can be moved to the winding position as shown in FIG. 2. The motor 78 and driving shaft 74 are then engaged again, causing the start end 114 that is trapped between protrusions 96 to begin to coil around the tapered portion 42 of the mandrel 38. The mandrel 38 begins to fill and the guide 122 begins to move from being aligned with the inboard flange plate 64 towards the flange plate 40, causing the individual wraps of the edge trim 28 to fill along the tapered portion 42 of the mandrel 38. As the master coil 14 becomes depleted, the mandrel 38 fills, eventually holding edge trim 28 of the entire length of the sheet metal 16 as a bundle 34. When the entire length of the edge trim 28 is held by the scrap winder 30, the pivoting frame 52 can then be moved to the release position as shown in FIG. 3, where gravity causes the coiled edge trim to fall onto a ramped surface 120 and then into the hopper 36.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A scrap winder for use with a slitting machine, said slitting machine having an uncoiling portion, a slitting portion, and a recoiling portion, said slitting machine adapted to generate a strip of edge trim, said scrap winder having:

a pivoting frame pivotable between a release position and a winding position, said pivoting frame having a mandrel rotatably affixed thereto and rotatable about a mandrel axis, said mandrel being tapered along its length to a tip;

an inboard flange plate having a center aperture and rotatable about a driving axis, said inboard plate having a mandrel facing surface and a yoke facing surface, said yoke facing surface having pins extending therefrom;

a sliding hub fixed from rotation with respect to said inboard plate and moveable axially through said center aperture between an extended position and a retracted position, said sliding hub fixed from rotation with respect to said inboard plate, said sliding hub having a front face, said retracted position defined by said front face being at a relatively close distance to said mandrel facing surface of said inboard plate, said extended position defined by said front face extending outward from said mandrel facing surface of said inboard plate, said sliding hub having a puller cable reel portion on said sliding hub located adjacent said front face, said puller cable reel portion is outward of said mandrel facing surface when said sliding hub is in said extended position, said front face of said inboard plate adapted to receive a distal end of said strip of edge trim;

a yoke having a sliding hub mating portion mated with an outer diameter of said sliding hub for shifting said sliding hub axially between its said extended position and said retracted position;

a driveshaft rotatable about said driving axis, said inboard plate fixed from rotation with respect to said driveshaft; and when said pivoting frame is in said winding position, said tip of said mandrel located at a relatively close position to said sliding hub and said mandrel axis substantially coaxial to said driving axis.

2. The scrap winder of claim 1, and a cable affixed at a terminal end to said sliding hub, said cable having a clip at another terminal end, said clip adapted to affix a start end of said strip of edge trim.

3. The scrap winder of claim 2, said puller cable reel consisting of a sheave.

4. The scrap winder of claim 3, an actuator for pivoting said yoke about a fulcrum for shifting said sliding hub axially.

5. The scrap winder of claim 4, and an oscillating guide having an aperture adapted to receive said scrap, said aperture moveable between a first position and a second position along an axis parallel to said driving axis, said first position defined by said aperture at a relatively close distance from said inboard plate, said second position defined by said aperture at a relatively far distance from said inboard plate.

6. The scrap winder of claim 5, and a motor driving said driveshaft, said inboard plate, and said sliding hub.

7. A scrap winder for use with a slitting machine, said slitting machine having an uncoiling portion, a slitting portion, and a recoiling portion, said slitting machine adapted to generate a strip of edge trim, said scrap winder having:

a pivoting frame pivotable between a release position and a winding position, said pivoting frame having a mandrel rotatably affixed thereto and rotatable about a mandrel axis;

a sliding hub axially moveable between an extended position and a retracted position on a driveshaft along a driving axis, said sliding hub fixed from rotation with respect to said driveshaft, said sliding hub having a front face, said retracted position defined by said front face being at a relatively large distance from said mandrel, said extended position defined by said front face relatively close to said mandrel, said sliding hub having a puller cable reel portion consisting of a sheave on said sliding hub located adjacent said front face, said puller cable reel portion is outward of said mandrel facing surface when said sliding hub is in said extended position, said front face adapted to receive a distal end of said strip of edge trim;

a yoke having a sliding hub mating portion mated with said sliding hub for shifting said sliding hub axially between its said extended position and retracted position; and a cable affixed at one terminal end to said puller cable reel portion, said cable having a retrieving end at another terminal end, said retrieving end adapted to affix a start end of said edge trim; and when said pivoting frame is in said winding position, said mandrel is located at a relatively close position to said sliding hub.

8. The scrap winder of claim 7, said front face having protrusions affixed thereto, said protrusions extending toward said mandrel.

9. The scrap winder of claim 8, said mandrel having a tip located at a distal end from said pivoting frame, said taper of said mandrel being smallest nearest said tip.

10. The scrap winder of claim 9, said yoke mating with an outer diameter of said sliding hub to facilitate movement between said extended and retracted position.

11. The scrap winder of claim 10, an actuator for pivoting said yoke about a fulcrum for shifting said sliding hub axially with respect to a driveshaft.

12. The scrap winder of claim 7, and an inboard plate having an aperture and rotatable about said driving axis, said sliding hub located in said aperture, said sliding hub and said inboard plate fixed from rotation with respect to said driveshaft.

13. The scrap winder of claim 12, said inboard plate having a mandrel facing surface and a yoke facing surface, said inboard plate having pins extending from said yoke facing surface, said sliding hub having apertures adapted to slidably receive said pins.

14. The scrap winder of claim 13, and an oscillating guide having an aperture adapted to receive said edge trim, said aperture moveable between a first position and a second position along a first axis, said first axis parallel to said driving axis, said first position defined by said aperture at a relatively close distance from said inboard plate, said second position defined by said aperture at a relatively far distance from said inboard plate.

15. The scrap winder of claim 14, and a motor driving said driveshaft, said inboard plate, and said sliding hub.

16. A scrap winder for use with a slitting machine, said slitting machine having an uncoiling portion, a slitting portion, and a recoiling portion, said slitting machine adapted to generate a strip of edge trim, said scrap winder having:

a mandrel moveable between a release position and a winding position, said mandrel rotatable about a mandrel axis and tapered along its length;

an inboard plate having a center aperture and fixed from rotation with respect to a driveshaft rotatable about a driving axis, said inboard plate having a mandrel facing surface and a yoke facing surface;

a sliding hub fixed from rotation with respect to said driveshaft and axially moveable along said driving axis through said center aperture between an extended position and a retracted position, said sliding hub having a front face, said refracted position defined by said front face being at a relatively close distance to said mandrel facing surface, said extended position defined by said front face extending outward from said mandrel facing surface, said sliding hub having a puller cable reel portion consisting of a sheave on said sliding hub located opposite said front face, said puller cable reel portion is outward of said mandrel facing surface when said sliding hub is in said extended position, said front face having a protrusion adapted to receive a distal end of said strip of edge trim;

a yoke having a sliding hub mating portion mated with said sliding hub for shifting said sliding hub between said extended position and retracted position; and when said mandrel is in said winding position, said mandrel located at a relatively close position to said sliding hub and said mandrel axis substantially coaxial to said driving axis.

17. The scrap winder of claim 16, and a cable affixed at one terminal end to said sliding hub, said cable having a retrieving end at the other terminal end, said retrieving end adapted to affix a start end of said strip of edge trim.

18. The scrap winder of claim 17, said yoke having a fulcrum and pivotable thereto, said yoke having an actuator attachment located oppositely said hub mating portion.

19. The scrap winder of claim 18, and a motor driving said driveshaft, said inboard plate, and said sliding hub.

* * * * *